US008844177B2

(12) United States Patent
De Vries et al.

(10) Patent No.: US 8,844,177 B2
(45) Date of Patent: Sep. 30, 2014

(54) IRON FEATURING LIQUID PHASE GARMENT MOISTURIZATION VIA SOLEPLATE

(75) Inventors: Johannes Hotze Bernhard De Vries, Eindhoven (NL); Stephanus Jacob Gerardus Tamminga, Eindhoven (NL); Paulus Cornelis Duineveld, Eindhoven (NL); Peter Sofrides Viet, Eindhoven (NL); Sepas Setayesh, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/813,508

(22) PCT Filed: Aug. 1, 2011

(86) PCT No.: PCT/IB2011/053414

§ 371 (c)(1),
(2), (4) Date: Jan. 31, 2013

(87) PCT Pub. No.: WO2012/020352

PCT Pub. Date: Feb. 16, 2012

(65) Prior Publication Data

US 2013/0125427 A1 May 23, 2013

(30) Foreign Application Priority Data

Aug. 12, 2010 (EP) ..... 10172590

(51) Int. Cl.

| | |
|---|---|
| ***D06F 75/22*** | (2006.01) |
| ***D06F 87/00*** | (2006.01) |
| *D06F 75/08* | (2006.01) |

(52) U.S. Cl.

CPC ..... *D06F 87/00* (2013.01); *D06F 75/22* (2013.01)

USPC ..... 38/77.1; 38/77.9

(58) Field of Classification Search

CPC ..... D05B 75/00; D05B 75/08; D05B 75/22; D05B 75/24; D05B 75/26; D05B 75/38; H05B 1/00; F22B 35/00; F22B 35/18; F22B 27/00; F22B 27/04

USPC ..... 38/77.1–77.83, 93; 219/245, 248, 225, 219/227, 249, 257; 392/403–406

See application file for complete search history.

(56) References Cited

U.S. PATENT DOCUMENTS

| | | | |
|---|---|---|---|
| 2,708,801 | A | 5/1955 | Voskresenski |
| 3,703,043 | A | 11/1972 | Ogata et al. |

(Continued)

FOREIGN PATENT DOCUMENTS

| | | | |
|---|---|---|---|
| DE | 19735214 | A1 | 2/1998 |
| DE | 212007000070 | U1 | 7/2009 |

(Continued)

*Primary Examiner* — Ismael Izaguirre

(57) ABSTRACT

An iron (1), comprising: —a water reservoir (16), configured to hold liquid water; —a heatable soleplate (20); —at least one water outlet opening (24); —a water atomization and distribution unit (30), configured to atomize water from the water reservoir and to distribute the atomized water to the at least one water outlet opening; —at least one sensor (40,42), configured to monitor at least one motion dependent variable of the iron and to generate a reference signal reflecting said variable; —a control unit (50), operatively connected to both the water atomization and distribution unit (30) and the at least one sensor (40, 42), and configured to control a water outflow rate of the at least one water outlet opening (24) by controlling the operation of the water atomization and distribution unit in dependence of the reference signal generated by the at least one sensor.

14 Claims, 3 Drawing Sheets

(56) References Cited

U.S. PATENT DOCUMENTS

| | | | | |
|---|---|---|---|---|
| 4,130,955 | A | 12/1978 | Baumgartner et al. | |
| 5,135,361 | A * | 8/1992 | Dion | 417/62 |
| 5,329,709 | A * | 7/1994 | Perez et al. | 38/77.7 |
| 5,642,579 | A | 7/1997 | Netten et al. | |
| 5,787,614 | A * | 8/1998 | Stutzer | 38/77.1 |
| 6,035,563 | A | 3/2000 | Hoefer et al. | |
| 8,091,257 | B2 * | 1/2012 | Aiura | 38/77.7 |
| 8,402,597 | B2 * | 3/2013 | Rosenzweig et al. | 15/339 |
| 8,464,445 | B2 * | 6/2013 | Jiang et al. | 38/77.7 |
| 8,613,151 | B2 * | 12/2013 | Rosenzweig et al. | 38/77.8 |
| 2004/0096369 | A1 * | 5/2004 | Daoting | 422/124 |
| 2005/0278987 | A1 * | 12/2005 | Ching et al. | 38/77.5 |
| 2011/0271565 | A1 * | 11/2011 | Ong et al. | 38/77.9 |
| 2012/0060396 | A1 * | 3/2012 | Collinson et al. | 38/77.6 |
| 2012/0319308 | A1 * | 12/2012 | Chen et al. | 261/28 |

FOREIGN PATENT DOCUMENTS

| | | | |
|---|---|---|---|
| GB | 0484974 | A | 5/1938 |
| JP | 05076700 | A | 3/1993 |
| JP | 2009061070 | A | 3/2009 |
| JP | 2009273560 | A | 11/2009 |
| WO | 2005014917 | A1 | 2/2005 |
| WO | 2008037863 | A2 | 4/2008 |

* cited by examiner

IRON FEATURING LIQUID PHASE GARMENT MOISTURIZATION VIA SOLEPLATE

FIELD OF THE INVENTION

The present disclosure relates to the field of garment care irons, and in particular to such irons featuring liquid phase moisturization to supply fine droplets of liquid water to a garment being ironed.

BACKGROUND OF THE INVENTION

Ironing may be described as the process of using an iron to remove wrinkles from a fabric, in particular a garment. During ironing, the fabric may preferably be heated to loosen the intermolecular bonds between the long-chain polymer molecules in the fibers of the fabric. In their loosened condition the weight of the iron may force the fibers in a wrinkle-free state. When the stress in the fibers is properly removed the wrinkle-free state of the fabric will be maintained upon cooling. The removal of stress in the fibers of the fabric is significantly enhanced by heating the fabric to above its glass transition temperature. For many natural fabrics, such as cotton, wool and linen, the glass transition temperature is dependent on the moisture content. The dependency is such that an increase in the moisture content or humidity lowers the transition temperature. A higher moisture content thus improves the degree of stress relaxation, and hence the ironing result at the same temperature. To achieve optimum ironing results, a moisture content of about 3-15% by weight of the fabric to be ironed is desired. The precise optimum percentage depends on the nature of the fabric, and may for example be relatively low for polyester while it is relatively high for natural materials such as cotton.

A fabric to be ironed may be moisturized in several ways.

A steam iron uses steam to moisturize a fabric. The steam is normally released through steam outlet openings in the heated soleplate of the iron, and moisturizes the fabric by subsequently condensing therein. A significant drawback of this approach is that steam is not a very efficient moisturizer: only a small fraction of the steam, typically on the order of several tens of percent, is used for moisturizing the fabric; the rest passes through it without condensing. The percentage of the steam that passes through the fabric even increases as the temperature of the fabric rises during ironing, simply because less steam condenses at higher temperatures. When the fabric reaches a temperature of 100° C. or above, no steam condensation occurs at all. This implies that steam irons are rather wasteful with both water and the energy required to evaporate it. Furthermore, steam irons are generally incapable of effecting the aforementioned optimum moisture content in the fabric.

U.S. Pat. No. 6,035,563 (Hoefer et al.) discloses an electric iron that moistens a fabric being ironed by means of liquid water. To this end the soleplate of the iron is provided with at least one water outlet opening, arranged in an area of the soleplate tip. The water outlet opening allows a liquid stored in a liquid tank to pass through and moisten materials to be ironed. The liquid exits the opening in the form of liquid droplets that are generated using a piezoelectric excitation atomizer device above the soleplate. The iron disclosed by U.S. '563 is capable of moisturizing a fabric up to the optimum moisture content. However, in doing so it may leave behind wet spots, i.e. a patch of fabric that has been moistened but incompletely dried thereafter, such that it is visibly left behind once the ironing stroke over said portion has ended.

This is undesirable because it requires a user to check for wet spots, and to 'mop up' any when found by moving the iron over it as long as it takes for the heated soleplate to evaporate them.

SUMMARY OF THE INVENTION

The present invention aims to solve this problem. It is therefore an object of the present invention to provide for a water and energy efficient iron that is capable of achieving an optimal moisture content in the fabric to be ironed, and that is not prone to leaving behind wet spots. The invention is defined by the independent claim. The dependent claims define advantageous embodiments.

According to a first aspect of the present invention, there is provided an iron. The iron includes a water reservoir configured to hold liquid water, a heatable soleplate, and at least one water outlet opening. The iron also includes water atomization and distribution unit, configured to atomize water from the water reservoir and to distribute the atomized water to the at least one water outlet opening. The iron further includes at least one sensor configured to monitor at least one motion dependent variable of the iron and to generate a reference signal reflecting said variable. The iron also includes a control unit, operatively connected to both the water atomization and distribution unit and the at least one sensor. The control unit is configured to control a water outflow rate of the at least one water outlet opening by controlling the operation of the water atomization and distribution unit in dependence of the reference signal generated by the at least one sensor.

A wet spot occurs when, during an ironing stroke, a water outlet opening releases more water than is subsequently evaporated by the heated soleplate portion that trails it, or can be quickly and invisibly absorbed by the fabric. The portion of the soleplate that trails a water outlet opening, its length, and the time during which it will be in contact with a moisturized portion of the fabric are generally dependent on motion dependent variables of the iron, such as its direction of movement and its speed. This means that the application of heat by the soleplate to a moisturized portion of the fabric, i.e. the drying action of the soleplate, is dependent on the movement of the iron. In the iron disclosed by U.S. '563 referred to above, no motion dependent parameters are taken into account when setting the water outflow rate of the at least one water outlet opening. Apparently, the water outflow rate is constant while the drying action applied to moisturized portions of fabric varies due to the variable movements of the iron. This will inevitably result in wet spots where portions of fabric are insufficiently dried. In agreement with this understanding, the present invention provides for an iron comprising a control unit that dynamically controls the water outflow rate of the at least one water outlet opening in the soleplate of the iron, based on motion dependent variables of the iron. As will be explained in more detail below, the control unit may implement a variety of control strategies. The two primary objectives of any control strategy, however, are (i) to effect an overall water outflow rate that results in the desired moisture content of about 3-15% by weight of the fabric being ironed, and (ii) to ensure that the water outflow rate of each water outlet opening corresponds to the expected drying action to be subsequently applied to a respective moisturized portion of the fabric during a same ironing stroke, such that substantially all deposited water is evaporated once the iron has moved over said portion of fabric and no wet spots are left behind.

According to an elaboration of the present invention, the soleplate of the iron may comprise a plurality of water outlet openings. These water outlet openings may be divided into a plurality of groups, to each of which groups the water atomization and distribution unit may selectively distribute atomized water. The control unit may be configured to control the water outflow rate for each group independently by controlling the operation of the water atomization and distribution unit in dependence of the reference signal generated by the at least one sensor.

Multiple water outlet openings distributed across the surface of the soleplate may be required to effect a defined, optimal moisture application to a fabric being ironed. However, the trailing soleplate lengths associated with these water outlet openings are bound to differ for different openings, at least for some directions of movement. Different water outlet openings may thus be associated with different drying actions, which means that their optimal moisturization performance calls for a degree of individual control. It may therefore be preferable to divide the plurality of water outlet openings into separate groups whose water outflow rates can be controlled independently. Each group may comprise at least one water outlet opening.

In a preferred embodiment of the ironman principal direction of motion of the iron coincides with a line of symmetry of the soleplate. A first group of water atomization openings is provided on a first side of said line of symmetry, while a second group of water atomization openings is provided on a second, opposite side of said symmetry line. In addition, the water outlet openings of said first and second groups are spaced apart from an edge of the soleplate such that a shortest distance from their respective centers to the edge is in the range of 1-30 mm.

Good moisturization performance at an acceptable number of groups (and hence an acceptable level of constructional complexity of the iron) may be achieved by dividing water outlet openings into groups on the basis of considerations relating to the principal direction(s) of movement, i.e. those directions that are most likely to be used. Irons featuring a tipped soleplate (cf. FIG. 3), for example, may generally have a principal direction of motion that extends along a symmetry/center line of the soleplate running through the tip. Water outlet openings may then be grouped such that, on the one hand, their associated trailing soleplate lengths are sufficient for optimum moisturization when the iron is moved in the principal direction, while on the other hand, adjustments of the water outflow rate are required only when the iron moves in a direction opposite to the principal direction of motion or perpendicular thereto. In an especially efficient embodiment, two groups of water outlet openings may be disposed on opposite sides of a symmetry line of the iron, along and near an edge of the soleplate. Placing the water outlet openings near an edge of the soleplate ensures that, when the iron moves perpendicularly to the principal direction, still one of the groups offers maximum trailing soleplate lengths.

In one embodiment of the iron according to the present invention, the water atomization and distribution unit may be configured to generate a mist of liquid water droplets having an average diameter in the range of 1-50 μm. Droplets of this size may effectively penetrate and moisturize a fabric being ironed.

In another embodiment, the water atomization and distribution unit may comprise at least one piezoelectric fluid atomizer for atomizing water from the water reservoir. A piezoelectric atomizer, such as a piezo driven perforated membrane or a piezo driven piston that forces water through a perforated membrane, may generally be reliable, cost-effective, and may allow the rate of generation of water droplets to be controlled easily by varying the electric drive signal provided to it.

According to an elaboration of the present invention, the at least one sensor is configured to monitor at least one of the following motion dependent variables of the iron: a direction of movement of the iron relative to a garment being ironed, a speed of the iron relative to a garment being ironed, and an acceleration of the iron.

The direction of movement of the iron relative to a garment, the speed with which the iron moves, and the time-variation of that speed are key parameters on the basis of which the drying action of the soleplate in relation to a water outlet opening or group of water outlet openings may be estimated. The at least one sensor may therefore include one or more sensors for monitoring these variables. These sensors may preferably be contactless, in the sense that they collect motion data without mechanical/physical contact with the garment being ironed. This is because the proper operation of contact-sensors that collect data through direct contact with the garment is generally sensitive to dust and fibers, while their accuracy may be adversely affected by temperature gradients present in the garment. Some examples of contactless sensors will be discussed below.

During ironing, the iron according to the present invention deposits water in the liquid phase onto the fabric being ironed. This fact may be used advantageously by adding water-soluble functional additives (e.g. artificial odours, wrinkle prevention and/or stain resistance substances) to the water in the water reservoir, which additives are then carried along by the water droplets, until they are released from the mist outlet openings in the soleplate of the iron and deposited onto the fabric. The integration of the additive application and the moisturization functions of the iron renders a separate additive spray system superfluous. Furthermore, the integration ensures that the additives are applied to portions of the fabric actually being ironed. This is in contrast to some known spray systems featuring a nozzle, mounted on the nose of the iron, which nozzle must be aimed at a spot in front of or next to the iron onto which the additive solution is to be sprayed. Known spray system may also suffer from the drawback that it may be hard to dose the additive solution precisely, and to apply the solution evenly to the fabric. The aforementioned integration overcomes these problems. The integration may be effected in different ways.

On a use level, a user may add an additive to the water in the water reservoir.

This approach, however, does not allow for selectively switching the use of the added additives on or off, or for changing the dosage/concentration of the additive. These drawbacks may be overcome by additional features on a hardware level. The iron may, for example, be fitted with a seperate, possibly detachable or disposable additive reservoir, configured to hold an additive or additive solution, and with a controllable additive dosing valve, configured to selectively bring the additive reservoir in fluid communication with the water atomization unit. The additive dosing valve, which may be under the control of the control unit, may allow the additive reservoir to be coupled to (an upstream side of) the water atomization unit, either exclusively or together with the water reservoir. In the former case only additive solution may be atomized. In the latter case additive solution from the additive reservoir and water from the water reservoir may be mixed upstream of the water atomization unit, such that atomization of a mixture of both may take place.

The molecular weight of any additive to be used with the iron may preferably be below 250,000 g/mole, and more preferably below 25,000 g/mole. The reason for this is that a relatively large molecular weight may hamper the droplet formation during atomization. A permanent or temporary wrinkle resistance may be induced by using non-formaldehyde based cross linkers and softeners using trimethylol melamine derivates, phosphinicosuccinic acid and its derivatives, poly-carboxulic acids, isocyanates and cationic surfactants. Water repellent additives such as organo fluoro compounds may be used to reduce the interaction of the garment with water, and to increase stain resistance. Furthermore, odour control additives based on amine containing polymers, and UV-protection additives based on UV-light absorbing quaternary polysiloxanes may also be used. The concentration of any of these additives in the deposited liquid droplets may preferably be in the range of 0.001-50% bw, and more preferably 0.5-20% bw.

According to another aspect of the present invention, there is provided a method of ironing a fabric. The method includes providing an iron according to the present invention; providing a fabric to be ironed, and ironing said fabric using said iron. The method may also include ironing with said iron while the water reservoir is at least partly filled with water to which at least one functional additive has been added.

These and other features and advantages of the invention will be more fully understood from the following detailed description of certain embodiments of the invention, taken together with the accompanying drawings, which are meant to illustrate and not to limit the invention.

DETAILED DESCRIPTION OF EMBODIMENTS

Figure 1:
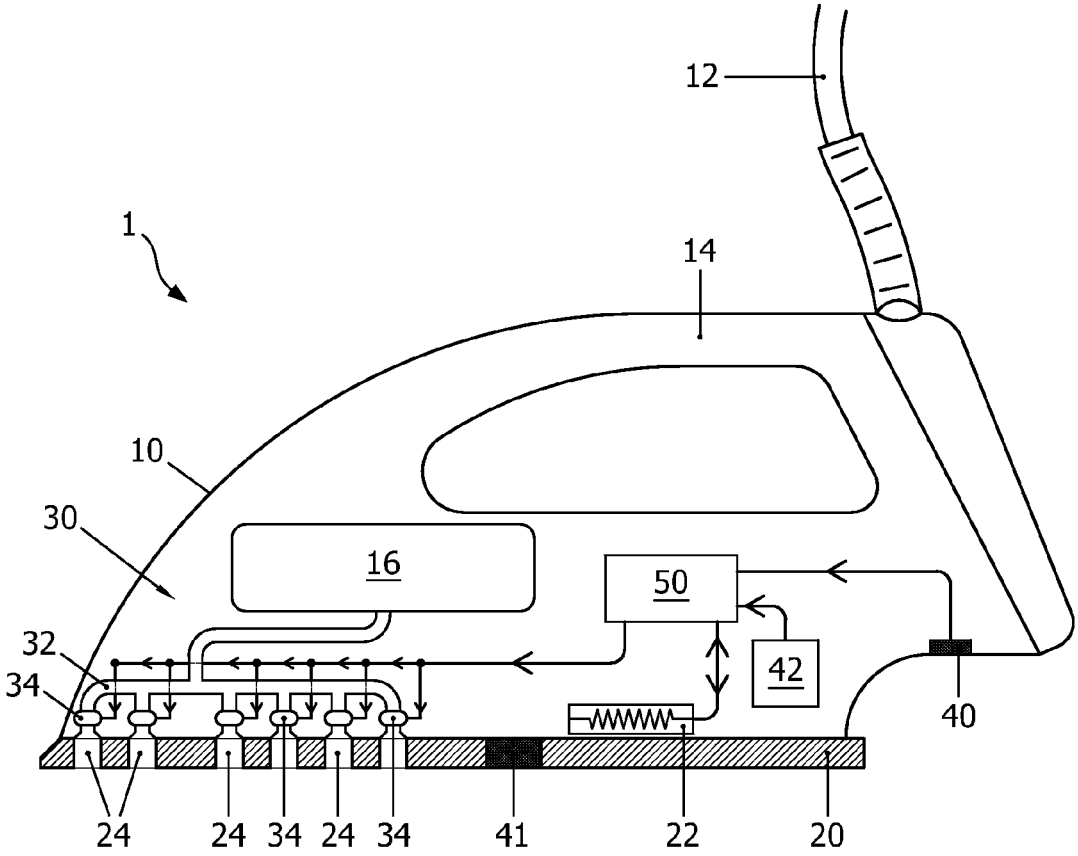
FIG. 1 schematically illustrates an exemplary iron according to the present invention.

FIG. 1 schematically depicts an exemplary iron 1 according to the present invention. Its construction will be briefly elaborated upon. The iron 1 may comprise a body 10, which in itself may be of a conventional design and which may have a power cord 12 connected thereto to supply any electronics inside the body 10 with electric power. On its upper side, the body 10 may be provided with a handle 14, while on its bottom side it may be connected to a soleplate 20.

The soleplate 20 may include one or more water outlet openings 24 for releasing water therefrom during ironing. These water outlet openings 24 may in principle be disposed in any desired pattern or configuration, while each water outlet opening 24 may have any suitable cross-sectional shape, e.g. circular, elliptical, etc. The soleplate 24 may further be heatable through heating elements, so as to enable the soleplate to give off heat during ironing for evaporating any released water. One skilled in the art will appreciate that a wide variety of heating elements may be applied for the purpose of heating the soleplate. Heating elements may, for example, include an electric heating element 22, as schematically depicted in FIG. 1. The electric heating element may comprise one or more electric resistors, e.g. one or more electrical resistance wires or a track of electric resistors printed on the soleplate 20 to provide for so-called 'flat heating', or be configured to heat the soleplate via inductive heating or via hot air streams led alongside or through channels in the soleplate. In any case, the heating elements may preferaby be arranged such that the soleplate 20 is substantially uniformly heatable, in particular between the water outlet openings 24.

The body 10 of the iron 1 may accommodate a water reservoir 16 configured to hold the liquid water that is to be released through the water outlet openings 24 in the soleplate 20. In an alternative embodiment, a water reservoir may be disposed outside of the (movable) iron body 10. The water reservoir may for example be disposed in an external stationary housing that may be placed next to an ironing board, and to which the iron body 10 may be detachably connectable. An advantage of such an external water reservoir is that it may typically have a larger storage capacity than an internal reservoir accommodated inside the body, while at the same time offering reduced weigth for, and thus improved handling of, the movable iron body 10.

The iron body 10 may further accommodate water atomization and distribution unit 30. These water atomization and distribution unit 30 may be configured to drive and/or distribute water along a path leading from the water reservoir 16 to the one or more water outlet openings 24 in the soleplate 20, and to atomize the water somewhere along that path. One skilled in the art will appreciate that these functions may be implemented in a variety of ways.

For atomizing the liquid water, the water atomization and distribution unit 30 may comprise one or more atomizers 34. An atomizer 34 may for example be a piezo(electric) fluid atomizer, such as a piezo driven perforated membrane or a piezo driven piston that forces water through a perforated membrane. The rate of generation of water droplets may then be controlled by varying the electric drive signal provided to the piezo atomizer 34. Alternatively, an atomizer 34 may take the form of a narrow orifice through which water may be forced at high pressure using an electric pump. In this case, the rate of generation of water droplets may be controlled by varying the drive signal supplied to the pump.

For distributing water from the water tank 16 to any atomizers 34, and from there to the water outlet openings 24, use may be made of one or more fluid channels 32. The water may be distributed through the fluid channels in different forms. Upstream of any atomizers 34, water may typically be transported in bulk, while downstream thereof it may typically be transported in the form of mist (water droplets suspended in air). Transport of the water through the fluid channels 32 may be driven by any suitable means, such as a fluid pump. Alternatively, the water may be driven through the channels 32 simply by means of gravity as in the embodiment of FIG. 1. It is noted that in the embodiment of FIG. 1, the atomizers 34 are disposed just above the water outlet openings 24 soleplate 20. Consequently, the atomizers 34 may impart generated water droplets with sufficient momentum to eject from through the water outlet openings 24, such that their inertia ensures their subsequent deposition on a fabric being ironed.

Different configurations of atomizers 34 and fluid channels 32 may be employed to distribute the water to the water outlet openings 24 in the soleplate 20 of the iron 1. In one embodiment, each water outlet opening 24 in the soleplate 20 may be provided with its own atomizer 34. The water outflow rate may then be controlled for each water outlet opening individually, while it is possible to control selected atomizers 34, e.g. associated with a group of water outlet openings 24, in coherence. See for example the embodiment of FIG. 1. In an alternative embodiment water outlet openings that have been grouped together may be interconnected through a common or shared fluid channel 32. Such a common fluid channel may be provided with a dedicated atomizer 34 and/or pump, so as to enable independent control over the water outflow rate of the associated group. In yet another embodiment, some or all fluid channels 32 may be connected to a common or shared atomizer 34 and/or pump, while one or more controllable valves (not shown) may be provided in said fluid channels, downstream of the common atomizer and/or pump, so as to allow for selective control over the water flow rate in said channels by opening and closing of the valves.

A control circuit 50 may be provided to control the operation of the water atomization and distribution unit 30, in particular to ensure that each water outlet opening 24 or group of water outlet openings releases water at an appropriate flow rate. For this purpose, the control circuit 50 may control the electric drive signals supplied to any (piezo) atomizers and/or fluid pumps. Alternatively, or in addition, the control circuit 50 may exercise control over one or more valves provided in the fluid channels 32, so as to effectively open or close one or more groups of water outlet openings 24. In some embodiments, the control circuit 50 may also exercise control over any heating element(s) 22 associated with the soleplate 20. The control circuit 50 may include a processor or integrated circuit that is configured execute a control strategy, based on reference signals reflecting one or more variables of the iron (e.g. direction of movement, speed, soleplate temperature, etc.), which reference signals may be received from sensors 40, 42 to which the control circuit 50 may be operatively connected.

The sensors may include one or more sensors 40, 42 configured to monitor at least one motion dependent variable of the iron 1, and to generate a reference signal reflecting said variable. Motion dependent variables of interest include a direction of movement of the iron relative to a fabric being ironed, a speed of the iron relative the said fabric, and variations in said speed (i.e. 'accelerations' in the broad meaning of the term). In principle, any suitable type of sensor may be used to monitor one or more motion dependent variables. Contactless-sensors, however, are preferred. This is because contact-sensors, which collect data through direct contact with the garment, are generally sensitive to contamination by dust and fibers, while their accuracy also may be adversely affected by temperature gradients present in the fabric being ironed. Contactless sensors may generally be placed anywhere in the iron body 10.

In one embodiment of the iron, the sensors may include an optoelectronic or optical sensor 40. The optoelectronic sensor 40 may, for example, be of a kind similar to that used in conventional computer mice and include a light source, e.g. a light-emitting diode (LED) or a laser diode, and an image sensor, e.g. a charge-coupled device (CCD) or complimentary metal-oxide semiconductor (CMOS) image sensor. During use, light originating from the light source and reflected by the fabric being ironed may be recorded by the image sensor. The recorded image data may be subsequently analyzed by a digital signal processor (DSP) of the optoelectronic sensor 40. The DSP may recognize time-variations in the recorded image data and infer therefrom information about the direction of movement of the iron 1, its speed and/or any changes in that speed. This information may then be coded into a reference signal and communicated to the control circuit 50. Of course, other types of optoelectronic sensors, e.g. optical correlators, may also be used. An optoelectronic sensor 40 may wholly or partly be incorporated in the soleplate 20 of the iron, e.g. at the position indicated by reference numeral 41, but such placement will generally require thermal insulation of the sensor to prevent it from overheating. Alternatively, the optoelectronic sensor 40 may be disposed at a distance from the soleplate 20, for example in the heel of the iron, at an elevated position above a fabric being ironed, as shown in FIG. 1.

Figure 2A:
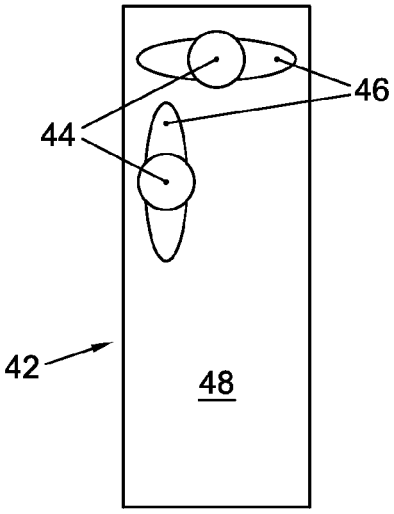
FIG. 2 schematically illustrates, in a top view (FIG. 2*a*) and a side view (FIG. 2*b*), a mechanical accelerometer that may be implemented the iron depicted in FIG. 1.
Figure 2B:
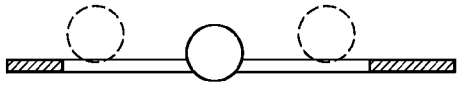

In another embodiment of the iron 1 the sensors may include an accelerometer. An exemplary, economically manufacturable mechanical accelerometer 42 is shown in top view in FIG. 2*a*. The accelerometer 42 includes two electrically conductive balls 44, each of which is rollably supported by the edges of an elliptic aperture 46 in a piece of printed circuit board 48. The major axis of the two elliptic apertures 46 extend at right angles (i.e. perpendicularly) to each other in order to provide for acceleration detection in two independent directions. The circuit board 48 provides for a plurality of electrical contacts (not shown) that are oppositely disposed in pairs along the edges of each of the apertures 46. A conductive ball 44 may selectively interconnect each of these pairs of contacts depending on its position relative to the respective aperture 46. An interconnection between two opposing electrical contacts is registered by a controller (not shown), which generates a reference signal for communication to the control circuit 50. The operation of the accelerometer is as follows: an acceleration of the iron 1 in a direction parallel to the major axis of an elliptic aperture 46 causes the respective ball 44 to move relative to that aperture, along the major axis thereof. Due to the varying width of the aperture 46 (measured in the direction perpendicular to the major axis) and the fixed diameter of the ball 44, a larger acceleration may 'lift' the ball 44 relative to the plane of the aperture 46 and bring it in a position closer to an end of the major axis. The position of the ball 44 relative to the aperture 46, which thus provides for a measure of the acceleration, is recorded by the electrical contacts along the edge of the aperture, and communicated to the control circuit 50 as described. It is understood that the accelerometer 42 may provide for information about changes in speed of the iron 1, and the direction in which the speed changes. Sustained accelerations may further indicate that the iron 1 has a certain minimum speed, while certain signals from the accelerometer 42 may indicate that the iron 1 has been parked on its heel, in an upright rest orientation. To minimize the influence of heat from the soleplate 20, the accelerometer 42 may preferably be placed at a distance therefrom, e.g. in the handle 14 of iron body. Of course, other types of accelerometers than the exemplary bi-axial, mechanical specimen illustrated with reference to FIG. 2 may be used in an iron according to the present invention. Examples of such other types of accelerometer include micro electro-mechanical system (MEMS) accelerometers, piezoelectric accelerometers, thermal accelerometers, capacitive accelerometers, piezo resistive accelerometers, shear mode accelerometers, null-balance accelerometers, strain gauge accelerometers, inductive accelerometers, optical accelerometers, surface acoustic wave accelerometers, triaxial accelerometers, accelerometers using modally tuned impact hammers, and pendulating integrating gyroscope accelerometers.

Apart from motion detecting sensors, the sensors may also include a temperature sensor (not shown), which sensor may be configured to monitor the temperature of the soleplate 20. Such a soleplate temperature sensor may for example be integrated with the soleplate heating element 22.

Now that the construction of the iron 1 according to the present invention has been elucidated, attention is invited to the operation thereof, which will be illustrated with reference to FIGS. 3 and 4.

Figure 3:
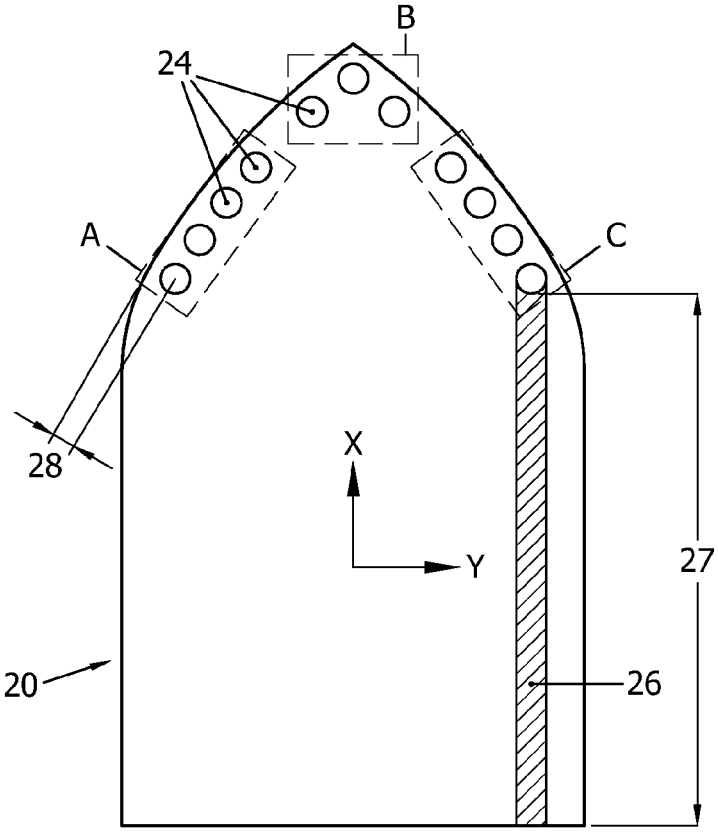
FIG. 3 schematically illustrates, in a bottom view, the soleplate of the iron depicted in FIG. 1, having a number of water outlet openings disposed along a front edge of the soleplate.

FIG. 3 schematically illustrates the soleplate 20 of the exemplary iron 1 shown in FIG. 1. The soleplate 20 comprises a plurality of water outlet openings 24, disposed next to each other, near and along a front edge of the soleplate. The water outlet openings 24 are grouped into three groups: group A, group B and group C, comprising four, three and four outlet openings, respectively. Each water outlet opening 24 has a circular cross-section.

The 'trailing soleplate length' associated with each of the water outlet openings 24 may be defined as the length of the soleplate portion that is disposed downstream of that opening. The trailing soleplate length associated with a water outlet opening 24 may thus depend on the direction of movement of the iron 1. In FIG. 3, reference numeral 26 indicates the soleplate portion that trails the rightmost water outlet opening 24 of group C when the iron 1 moves in the positive x-direction. Reference number 27 indicates the corresponding trailing soleplate length. It is understood that the trailing soleplate length 27 associated with a water outlet opening 24 serves as a measure for the amount of heat that will be applied to a piece of fabric that is moisturized via said opening.

The exemplary soleplate 20 of FIG. 3 possesses line symmetry with respect to the indicated x-axis, which also points in a principal direction of movement of the iron 1. The water outlet openings 24 have been grouped such that all groups A-C are within the 'front half' thereof, maximizing their average trailing soleplate length for movements in the principal x-direction, while together covering virtually the entire width of the soleplate (measured in the y-direction). During ironings movements in the principal x-direction therefore, all water outlet openings 24 may be allowed to release water so as to moisturize a fabric being ironed over the entire width of the soleplate 20. Should the iron 1 move in a direction perpendicular to the principal x-direction, e.g. in the negative y-direction, then the release of water through groups B and C may be stopped, while group A may still be allowed to deposit water. Due to placement of the water outlet openings 24 of group A close to the edge of the soleplate 20, these openings still have a considerable trailing soleplate length despite the suboptimal direction of movement. In practical embodiments, the center-to-edge distance 28 of the openings 24 of groups of water outlet openings 24 disposed along the edge of the soleplate may preferably in the range of 1-30 mm.

Figure 4:
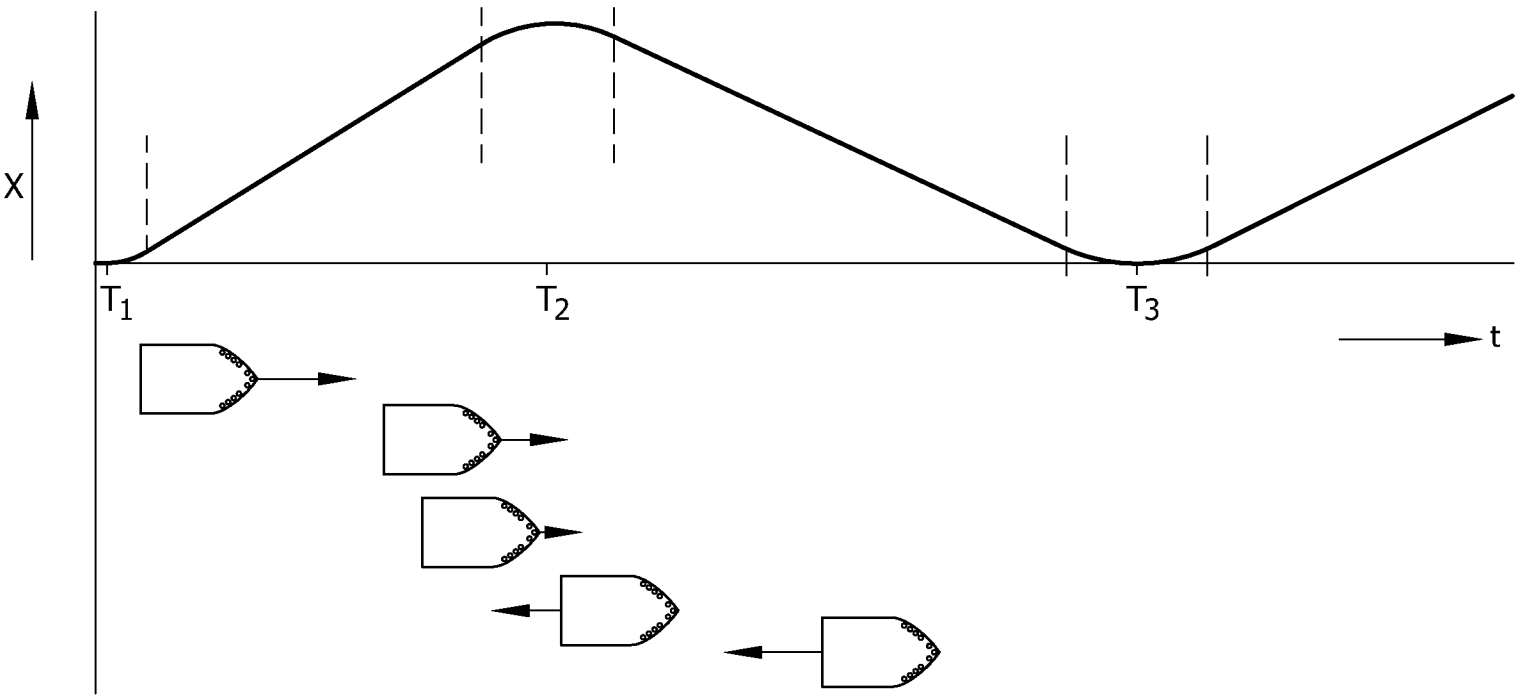
FIG. 4 is a schematical place-time diagram that illustrates a repetitive back-and-forth iron movement of the kind that often occurs when a user executes consecutive ironing strokes while ironing a garment.

To explore the problem solved by the present invention somewhat further, additional reference is made to FIG. 4. The figure diagramatically illustrates a common, repetitive back-and-forth iron movement of the kind that often occurs when a user executes consecutive ironing strokes while ironing a garment or the like. The depicted diagram shows an x-axis, indicating the position of the iron 1, and a t-axis, indicating the course of time. The depicted curve indicates the position of the iron 1 as a function of time. Below the t-axis, the soleplate 20 of the iron 1 is depicted for several points in time, in each case accompanied by a vector or arrow whose length indicates the magnitude of the speed of the iron. A vector pointing to the right corresponds to a speed in the positive x-direction, while a vector pointing to the left corresponds to a speed in the negative x-direction. For ease of demonstration it will be assumed that, during the depicted movement, the water outlet openings 24 of all three groups A, B, C continuously deliver water at a constant water outflow rate. More in particular, it will be assumed the water outflow rate is set such that the water released during the forward movement in the x-direction is just evaporated by the trailing soleplate.

Now, when the iron 1 is moved forward in the positive x-direction, e.g. between T1 and T2, each water outlet opening 24 is trailed by a portion of the heated soleplate 20. As all released water is precisely evaporated by the trailing soleplate, no wet spots are left behind. However, at T2 the first ironing stroke ends and the direction of the movement is reversed. Between T2 and T3 the iron is moved in the negative X-direction, and the water outlet openings 24 are no longer trailed by a portion of the heated soleplate 20. Water released by the water outlet openings 24 during the movement between T2 and T3 is thus not evaporated, and the iron 1 will leave behind a wet trail. Although this is not illustrated in FIG. 4, the direction dependency of the trailing soleplate length may, of course, also play a role when the iron is moved in another direction than the x-direction, e.g. when the iron is moved in the positive y-direction (cf. FIG. 3). In that case, only the water outlet openings 24 of group C are trailed by a portion of the heated soleplate 20, so that only part of the water released by the openings of group C is evaporated. In contrast, water deposited via the water outlet openings 24 of groups A and B will not be evaporated due to the virtually complete lack of a trailing soleplate portion associated with these groups, which again may result in wet spots and a damp fabric upon finishing the ironing job.

Besides the direction dependency of the trailing soleplate length, FIG. 4 illustrates a related issue that is targeted by the present invention. This issue concerns variations in the speed of the iron. For example, as the iron approaches the end of the first ironing stroke, at T2, it is slowed down before it comes to a momentary standstill. Immediately after the standstill at T2, the iron is sped up again (in the opposite direction). Around the point of standstill, the speed of the iron is relatively low. In case the water outflow rate of the water outlet openings 24 is kept constant, too much water may be released around the point of standstill for the soleplate 20 to evaporate. This is due to the fact that a too small trailing soleplate portion may be brought into contact with the moisturized portion of fabric for too little time. Again, a wet spot may result.

The iron 1 according to the present invention solves the problem of wet spots through motion dependent control of the water outflow rate of the water outlet opening(s) 24 in the soleplate 20. Control over the water outflow rate is effected by the control circuit 50, which on the one hand receive input about one or more motion dependent variables of the iron from the sensors 40, 42, and on the other hand output control instructions to the water atomization and distribution unit 30 that effectively regulate the rate of water atomization and/or water release. The control strategy to be executed by the control circuit 50 may preferably center around a number of rules of thumb, which will be briefly discussed here.

The portion of the soleplate that trails a water outlet opening 24, and thus the length thereof, is determined by the direction of movement of the iron 1. It is understood that, everything else being equal, a longer trailing soleplate portion may result in a longer heating time of any fabric portion moisturized via the water outlet opening, and thus in a larger drying action. The control circuit 50 may therefore be configured to control the water outflow rate of a water outlet opening 24 (or group of water outlet openings) in dependence of the direction of movement of the iron 1, such that the water outflow rate for said water outlet opening 24 increases when the trailing soleplate length increases, and/or vice versa. To avoid situations wherein the risk of wet spots may arise, the control circuit 50 may, by way of threshold, observe a minimum trailing soleplate length, such that said water outlet opening 24 is made to release water only when it is associated with a trailing soleplate length that exceeds the predetermined minimum trailing soleplate length.

Besides the direction of movement and the related trailing soleplate length, the control circuit 50 may also reckon with iron speed and speed variations. These parameters may be important because the evaporation rate of deposited water does not depend linearly on the contact time between the trailing soleplate portion and the moisturized fabric. Generally, the control circuit 50 may be configured to control the water outflow rate of a water outlet opening (or group of water outlet openings) in dependence of a speed of the iron, such that the water outflow rate for the water outlet opening is increased when the speed of the iron is increased, and/or vice versa. To avoid situations wherein the risk of wet spots may arise, in particular around turning points between ironing strokes, the control circuit 50 may observe a minimum speed requirement. Accordingly, a water outlet opening (or group of water outlet openings) may be made to release water only when the speed of the iron exceeds a predetermined minimum speed. Likewise, the increase of the water outflow rate may be subject to a maximum.

The sensors may enable the control circuit 50 to detect that the soleplate 20 is lifted from the ironing board, and put/held in a non-ironing position, e.g. that the iron body 10 is freely suspended or parked on its heel. For example, in case the sensors include an optical sensor, the strength of its received reflected signal will decrease when the iron body is lifted; in case the sensors include an acceleration sensor, any detected vertical acceleration may indicate a lift-off. In particular for reasons of safety, the control circuit 50 may be configured to detect such a lift-off of the soleplate 20 from the ironing board, and to control the water outflow rate of at least one (and preferably all) water outflow openings such that the outflow of water is stopped or at least reduced to a predetermined value during time-intervals of lift-off.

Furthermore, the control circuit 50 may be configured to control the water outflow rate of at least one water outlet opening 24 in dependence of a reference signal that is received from a soleplate temperature sensor. The soleplate temperature sensor may be operably connected to the control circuit 50 and be configured to generate a reference signal comprising information about a temperature of the soleplate 20. In one embodiment, the control circuit 50 may for example be configured to control the rate of mist generation/water atomization by an atomizer of the water atomization and distribution unit 30 in dependence of the soleplate temperature. Generally, the control circuit 50 may be configured such that a greater soleplate temperature is associated with a greater water outflow rate/rate of mist generation. Mist may for example be generated at a rate of about 0-5 grams/minute for low soleplate temperatures (e.g. 1 dot on the temperature dial), at a rate of 5-10 grams/minute for medium soleplate temperatures (e.g. 2 dots on the temperature dial), and at a rate of 10-20 grams/minute for high soleplate temperatures (e.g. 3 dots on the temperature dial). Having the control circuit 50 respond to the actual/measured soleplate temperature instead of a user temperature setting prevents mist generation at too high a rate when the soleplate has a temperature that lies below the set temperature target value, in which case wet spots might result.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware (e.g. a circuit or other unit) comprising several distinct elements, and/or by means of a suitably programmed processor. In the device claim enumerating several means, several of these means may be embodied by one and the same item of hardware.

List of Elements

1 iron
10 iron body
12 power cord
14 handle
16 water reservoir
20 heatable soleplate
22 electric heating element
24 water outlet openings
26 trailing soleplate portion associated with the rightmost water outlet opening of group C when the iron moves in the positive x-direction
27 length of trailing soleplate portion 26
28 shortest distance between water outlet opening and soleplate edge
30 water atomization and distribution unit
32 fluid channel
34 piezo atomizer
40 optoelectronic sensor
41 alternative position for optoelectronic sensor
42 accelerometer
44 conductive balls of accelerometer
46 elliptic aperture
48 piece of printed circuit board
50 control circuit
A, B, C groups of water outlet openings
X,Y perpendicular directions defining 2D-coordinate system
T1, T2, . . . moments in time indicated along the time axis in FIG. 4

The invention claimed is:

1. An iron, comprising:

a water reservoir, configured to hold liquid water;

a heatable soleplate;

at least one water outlet opening;

a water atomization and distribution unit, configured to atomize water from the water reservoir and to distribute the atomized water to the at least one water outlet opening;

at least one sensor, configured to monitor at least one motion dependent variable of the iron, including a direction of movement of the iron relative to a fabric being ironed and to generate a reference signal reflecting said variable; and a control unit, operatively connected to both the water atomization and distribution unit and the at least one sensor, and configured to control a water outflow rate of the at least one water outlet opening by controlling the operation of the water atomization and distribution unit in dependence of the reference signal generated by the at least one sensor, characterized in that the control unit is configured to control the water outflow rate of at least one water outlet opening in dependence of a direction of movement of the iron, such that the water outflow rate of said water outlet opening is increased when its associated trailing soleplate length increases as a result of a change in said direction of movement, and/or vice versa.

2. The iron according to claim 1, wherein the soleplate comprises a plurality of water outlet openings, said water outlet openings being divided into a plurality of groups (A, B, C), wherein the water atomization and distribution unit is configured to selectively distribute atomized water to each of said groups, and wherein the control unit is configured to control the water outflow rate for each group independently by controlling the operation of the water atomization and distribution unit in dependence of the reference signal generated by the at least one sensor.

3. The iron according to claim 2, wherein a principal direction of motion (X) of the iron coincides with a line of symmetry of the soleplate, and wherein a first group (A) of water atomization openings is provided on a first side of said line of symmetry, while a second group (C) of water atomization openings is provided on a second, opposite side of said symmetry line, and wherein the water outlet openings of said first and second groups (A,C) are spaced apart from an edge of the soleplate such that a shortest distance from their respective centers to the edge is in the range of 1-30 mm.

4. The iron according to claim 1, wherein the water atomization and distribution unit is configured to generate a mist of liquid water droplets having an average diameter in the range of 1-50 μm.

5. The iron according to claim 1, wherein the at least one sensor is configured to additionally monitor at least one of the following motion dependent variables of the iron:

a speed of the iron relative to a fabric being ironed, and an acceleration of the iron.

6. The iron according to claim 5, wherein the at least one sensor comprises a contactless motion sensor that is configured to collect motion data without making physical contact with a fabric being ironed.

7. The iron according to claim 6, wherein the contactless motion sensor is an optoelectronic motion sensor.

8. The iron according to claim 6, wherein the contactless motion sensor is an accelerometer.

9. The iron according to claim 1, wherein the control unit is configured to control the water outflow rate of the at least one water outlet opening such that—in use—substantially all water deposited on a patch of fabric being ironed is subsequently evaporated by a trailing soleplate portion associated with said at least one water outlet opening.

10. The iron according to claim 9, wherein the control unit is configured to control the water outflow rate of at least one water outlet opening in dependence of a direction of movement of the iron, such that said water outlet opening is made to release water only when it is associated with a trailing soleplate length that exceeds a predetermined minimum trailing soleplate length.

11. The iron according to claim 10, wherein the control unit is configured to control the water outflow rate of at least one water outlet opening in dependence of a speed of the iron, such that the water outflow rate of said water outlet opening is increased when the speed of the iron is increased, and/or vice versa.

12. The iron according to claim 11, wherein the control unit is configured to control the water outflow rate of at least one water outlet opening in dependence of a speed of the iron, such that said water outlet opening is made to release water only when the speed of the iron exceeds a predetermined minimum speed.

13. The iron according to claim 12, wherein the at least one sensor further comprises:

a soleplate temperature sensor that is operably connected to the control unit and configured to generate a reference signal comprising information about a temperature of the soleplate, and wherein the control unit is further configured to control the water outflow rate of at least one water outlet opening in dependence of the reference signal from the soleplate temperature sensor.

14. The iron according to claim 13, further comprising:

an additive reservoir, configured to hold an additive or additive solution; and a controllable additive dosing valve, configured to selectively bring the additive and reservoir in fluid communication with the water atomization and distribution unit.

* * * * *